US012152351B2

(12) United States Patent
Reynolds, Jr. et al.

(10) Patent No.: US 12,152,351 B2
(45) Date of Patent: Nov. 26, 2024

(54) TRACK RAIL FASTENING SYSTEM HAVING CANTILEVERED THIRD RAIL SUPPORT BRACKET AND DIRECT FIXATION FASTENER ASSEMBLY FOR SAME

(71) Applicant: Progress Rail Services Corporation, Albertville, AL (US)

(72) Inventors: Mark Louis Reynolds, Jr., Grandview, MO (US); Scott Osler, Southold, NY (US)

(73) Assignee: Progress Rail Services Corporation, Albertville, AL (US)

( * ) Notice: Subject to any disclaimer, the term of this patent is extended or adjusted under 35 U.S.C. 154(b) by 234 days.

(21) Appl. No.: 17/112,200

(22) Filed: Dec. 4, 2020

(65) Prior Publication Data

US 2022/0178083 A1 Jun. 9, 2022

(51) Int. Cl.

| | |
|---|---|
| ***E01B 9/60*** | (2006.01) |
| ***E01B 3/40*** | (2006.01) |
| ***E01B 26/00*** | (2006.01) |

(52) U.S. Cl.

CPC ..... *E01B 9/60* (2013.01); *E01B 3/40* (2013.01); *E01B 26/00* (2013.01)

(58) Field of Classification Search

CPC ..... E01B 9/60; E01B 9/64; E01B 9/00; E01B 3/32; E01B 26/00; E01B 26/005; E01B 3/40; E01B 3/28; E01B 3/22; E01B 3/20; E01B 3/18; E01B 3/24; E01B 3/36; E01B 3/38; E01B 3/44

See application file for complete search history.

(56) References Cited

U.S. PATENT DOCUMENTS 145,991 A * 12/1873 De Zeng ..... E01B 3/16 238/61
1,584,648 A * 5/1926 Randall ..... E01B 3/32 238/338

(Continued)

FOREIGN PATENT DOCUMENTS

DE 29710219 U1 * 8/1997 ..... B60M 1/307
EP 0603927 A2 6/1994

(Continued)

OTHER PUBLICATIONS

Written Opinion and International Search Report for Int'l. Patent Appln. No. PCT/US2021/061119, mailed Mar. 25, 2022 (11 pgs).

*Primary Examiner* — Zachary L Kuhfuss
*Assistant Examiner* — Cheng Lin

(57) ABSTRACT

A track rail fastening system includes a direct fixation fastener assembly having a direct fixation fastener, and a laterally elongated support block. Fastener holes for receiving fastener-clamping fasteners, and fastener holes for receiving bracket-clamping fasteners, are formed in the support block. The respective sets of fastener holes are arranged in different anchor patterns. Fastener-clamping fasteners are received in one of the sets of fastener holes and claim direct fixation fastener to the support block. Bracket-clamping fasteners clamp a third-rail support bracket to the support block, and are received in one of the sets of fastener holes. The third-rail support bracket is cantilevered to the support block.

13 Claims, 3 Drawing Sheets

(56) References Cited

U.S. PATENT DOCUMENTS

| | | | | |
|---|---|---|---|---|
| 3,437,765 | A * | 4/1969 | Harmsen | B60M 1/307 191/32 |
| 3,576,293 | A | 4/1971 | Landis et al. | |
| 3,735,845 | A * | 5/1973 | Harmsen | B60M 1/307 191/32 |
| 3,945,566 | A | 3/1976 | Bush | |
| 5,785,419 | A | 7/1998 | McKelvey | |
| 6,167,669 | B1 | 1/2001 | Lanc | |
| 6,488,215 | B2 | 12/2002 | Mohr | |
| 6,659,363 | B2 | 12/2003 | Mohr | |
| 7,156,319 | B2 | 1/2007 | Kowalski | |
| 8,033,480 | B2 * | 10/2011 | Hohne | E01B 9/303 238/315 |
| 8,580,177 | B2 | 11/2013 | Van Der Houwen | |
| 9,004,372 | B1 | 4/2015 | Alsop et al. | |
| 9,670,623 | B2 | 6/2017 | Ciloglu et al. | |
| 10,081,915 | B2 * | 9/2018 | Constantine | E01B 9/483 |
| 10,253,512 | B2 | 4/2019 | McAuley et al. | |
| 10,352,000 | B2 | 7/2019 | Raymond | |
| 2015/0013255 | A1 | 1/2015 | Hunt | |
| 2020/0299980 | A1 | 9/2020 | McAuley et al. | |
| 2020/0308773 | A1 | 10/2020 | Constantine | |

FOREIGN PATENT DOCUMENTS

| | | | |
|---|---|---|---|
| EP | 2420620 | A1 | 2/2012 |
| JP | 2010101132 | A | 5/2010 |
| JP | 2012144868 | A | 8/2012 |
| JP | 2016089503 | A | 5/2016 |
| KR | 20070008034 | A | 1/2007 |
| WO | 2008/040549 | A1 | 4/2008 |

* cited by examiner

TRACK RAIL FASTENING SYSTEM HAVING CANTILEVERED THIRD RAIL SUPPORT BRACKET AND DIRECT FIXATION FASTENER ASSEMBLY FOR SAME

TECHNICAL FIELD

The present disclosure relates generally to a track rail fastening system, and more particularly to a direct fixation fastener assembly having a laterally elongated support block and a direct fixation fastener, and a third-rail support bracket mounted thereon.

BACKGROUND

Rail equipment is used globally for transportation of persons and all manner of goods and equipment. Rail lines for freight, passenger, or commuter trains are generally formed by parallel track rails supported upon a concrete or gravel substrate, for example, and will be familiar to most. A great many different fastening mechanisms have been developed over the years for positioning and supporting tracks rails and attaching the track rails to underlying structures resident in or on the substrate. Such fastening mechanisms are also often engineered to manage loads and vibrations transmitted by way of the rail and fasteners between rail cars, locomotives, or other rail equipment, and the substrate. Fasteners for track rail can range from simple cast or forged metallic plates that attach rails to wooden ties with spikes, to sophisticated direct fixation fasteners formed from an assembly of metallic and non-metallic components.

Servicing or original installation of track rail can be a labor-intensive endeavor, regardless of the specific fixation strategy used. In new construction of a rail line, or replacement of an aging line, it is common for track rail to be suspended above a prepared "deck" and then concrete poured to a desired elevation to form the supporting underlying substrate. Direct pour techniques are commonly, although not exclusively, used in rail tunnels. The placement of reinforcements and framing, positioning of the track rail as desired, pouring of the concrete, and related activities can require multiple personnel and various types of machinery. When a so-called third rail for electrification of rail equipment is used, generally placed in parallel to the main or load supporting track rails, additional complexities to installation and service can be observed.

One known strategy for direct fixation of track rail is set forth in U.S. Pat. No. 10,081,915 to Constantine. In Constantine's strategy, a mechanism for coupling a track rail to a substrate having a rail plate and a base plate is proposed. Constantine undoubtedly has a variety of applications, however, engineers are always seeking improvements, extensions of existing technology, and alternative strategies.

SUMMARY OF THE INVENTION

In one aspect, a track rail fastening system includes a laterally elongated support block having a first lateral side, a second lateral side, a ground-facing lower side, and an upper side opposite to the lower side and having an upper fastening surface. The fastening system further includes a direct fixation fastener positioned upon the upper fastening surface adjacent to the first lateral side, and including a metallic frame having an upper rail plate, and a non-metallic jacket. The fastening system further includes fastener-clamping fasteners coupling the direct fixation fastener to the support block upon the upper fastening surface, and a third-rail support bracket having an inboard bracket end adjacent to the direct fixation fastener, and an outboard bracket end, and bracket-clamping fasteners coupling the inboard bracket end to the support block upon the upper fastening surface. The third-rail support bracket projects laterally outward of the second lateral side, such that the outboard bracket end is cantilevered to the support block.

In another aspect, a direct fixation fastener assembly includes a direct fixation fastener having a metallic frame with an upper rail plate, and a non-metallic jacket. A laterally elongated support block having a first lateral side, a second lateral side, a forward side, a back side, a ground-facing lower side, and an upper side opposite to the lower side and having an upper fastening surface. At least one of, the first lateral side and the second lateral side, or the forward side and the back side, together form an upwardly narrowed taper. A first set of fastener holes are formed in the support block and open in the upper fastening surface, and fastener-clamping anchors are resident in the first set of fastener holes to receive fastener-clamping fasteners for clamping the direct fixation fastener to the upper fastening surface. A second set of fastener holes are formed in the support block and open in the upper fastening surface, and bracket-clamping anchors are resident in the second set of fastener holes to receive bracket-clamping fasteners clamping a third-rail support bracket to the upper fastening surface. The first set of fastener holes are arranged in a first anchor pattern, and the second set of fastener holes are arranged in a second anchor pattern different from the first anchor pattern.

In still another aspect, a direct fixation fastener assembly includes a direct fixation fastener, and a laterally elongated support block including a first lateral side, a second lateral side, a ground-facing lower side, and an upper side opposite to the lower side and having an upper fastening surface. A first set of fastener holes are formed in the support block and open in the upper fastening surface to receive fastener-clamping fasteners for clamping the direct fixation fastener to the upper fastening surface. A second set of fastener holes are formed in the support block and open in the upper fastening surface to receive bracket-clamping fasteners for clamping a third-rail support bracket to the upper fastening surface adjacent to the direct fixation fastener. The first set of fastener holes are arranged in a first anchor pattern, and are confined in distribution to a right-side portion of the support block extending from the first lateral side toward the second lateral side. The second set of fastener holes are arranged in a second anchor pattern different from the first anchor pattern, and are confined in distribution to a left-side portion of the support block extending from the second lateral side toward the first lateral side.

DETAILED DESCRIPTION

Figure 1:
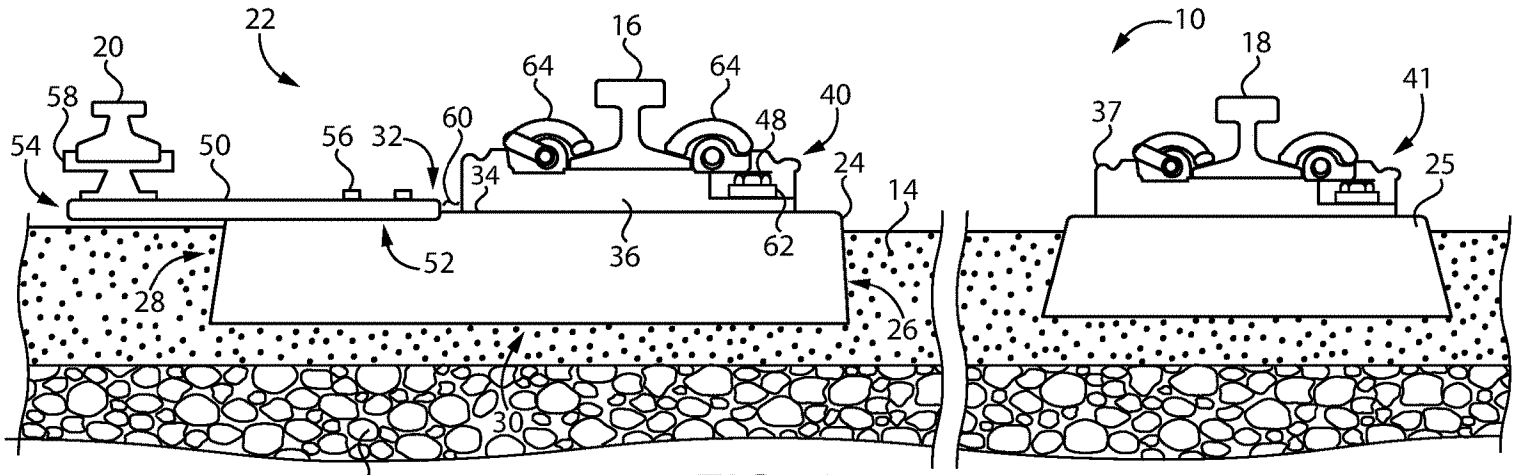
FIG. 1 is a diagrammatic view of a track rail fastening system, according to one embodiment.

Referring to FIG. 1, there is shown a track system 10, according to one embodiment and including a prepared deck 12 formed, for example, of a suitable aggregate material, and poured concrete 14 upon deck 12. Track system 10 includes a first track rail 16, a second track rail 18, and a third rail 20, which may be electrified for purposes well-known in the art. First track rail 16 and second track rail 18 may be positioned at a standard gauge, with third rail 20 positioned outboard of and extending in parallel with first track rail 16. Track rail 18 may be supported upon a support block 25 and fastened to support block 25 by way of a direct fixation fastener 37. Direct fixation fastener 37 and support block 25 together form a direct fixation fastener assembly 41. Track rail 16 may be supported upon a laterally elongated support block 24 by way of a direct fixation fastener 36, with direct fixation fastener 36 and support block 24 forming a direct fixation fastener assembly 40. Embodiments are contemplated where a single support block is attached to two or more direct fixation fasteners to support both of first track rail 16 and second track rail 18, as well as embodiments where more than two track rails are supported by a single support block, such as in a rail turnout or in the case of two parallel, adjacent rail lines.

Figure 2:
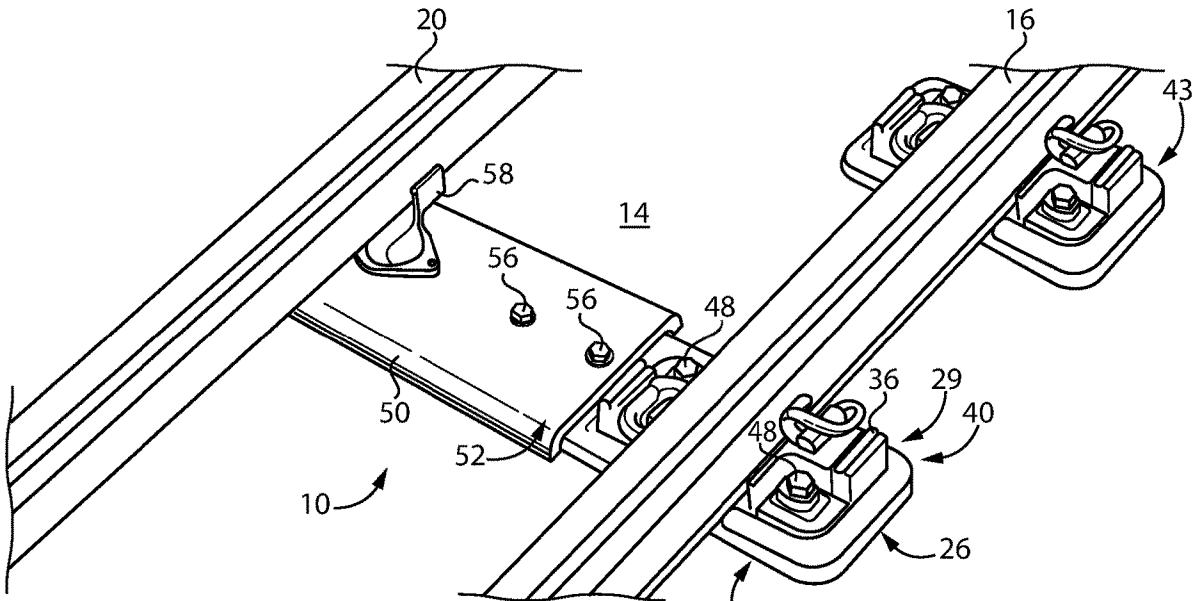
FIG. 2 is a diagrammatic perspective view of a track rail fastening system, according to one embodiment.

Referring also now to FIG. 2, support block 24 includes a first lateral side 26, a second lateral side 28, a ground-facing lower side 30, a forward side 29, a back side 31, and an upper side 32 opposite to lower side 30 and having an upper fastening surface 34 formed thereon. Upper fastening surface 34 may be uniformly substantially planar throughout. Direct fixation fastener 36 is positioned upon upper fastening surface 34 adjacent to first lateral side 26. Track rail fastening system 22 further includes fastener-clamping fasteners 48 coupling direct fixation fastener 36 to support block 24 upon upper fastening surface 34, and clamping direct fixation fastener 36 to upper fastening surface 34 when track rail fastening system 22 is assembled for service in track system 10. As can also be seen in FIG. 2, an additional direct fixation fastener assembly 43 is provided spaced longitudinally along first track rail 16 from direct fixation fastener assembly 40. It will be appreciated that a plurality of direct fixation fastener assemblies may be provided at spaced-apart locations along a length of track rails as contemplated herein. Track system 10 can be implemented in a rail tunnel in some embodiments, however, the present disclosure is not thereby limited. As will be further apparent from the following description, track rail fastening system 22 provides an advantageous and efficient strategy for installation of track systems, and particularly those utilizing a third rail.

Fastening system 22 further includes an elongate third-rail support bracket 50 having an inboard bracket end 52 adjacent to direct fixation fastener 36, and an outboard bracket end 54. Bracket-clamping fasteners 56 couple inboard bracket end 52 to support block 24 upon upper fastening surface 34, and clamp third-rail support bracket 50 to fastening surface 34 when fastening system 22 is assembled for service in track system 10. Third-rail support bracket 50 projects laterally outward of second lateral side 28, such that outboard bracket end 54 is cantilevered to support block 24. Fastening system 22 further includes an upwardly projecting pedestal mount 58 attached to outboard bracket end 54 and supporting third rail 20. It can further be seen from the drawings that a clearance 60 extends laterally between third-rail support bracket 50 and direct fixation fastener 36. Direct fixation fastener 36 may be equipped with a lateral positioner 62, or multiple lateral positioners 62, each associated with one of fastener-clamping fasteners 48 and structured to enable a lateral position of direct fixation fastener 36 to be adjusted to set, vary, or maintain a desired rail gauge of first track rail 16 and second track rail 18, with clearance 60 providing space for such lateral adjustment. Rail clips 64, such as so-called E-clips, may be provided for clamping track rail 16 to direct fixation fastener 36 in a generally known manner.

Figure 4:
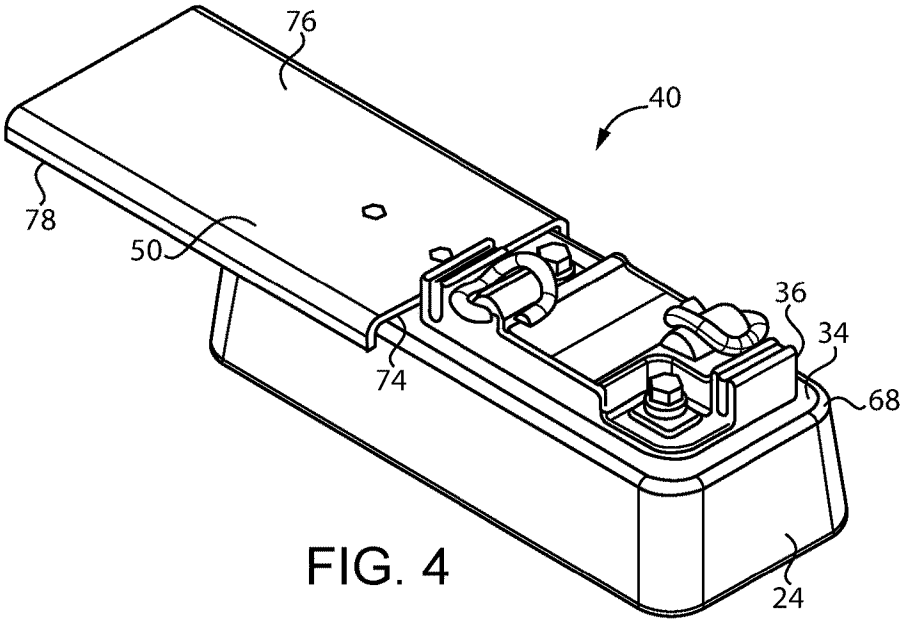
FIG. 4 is a perspective view of a direct fixation fastener assembly, according to one embodiment.
Figure 3:
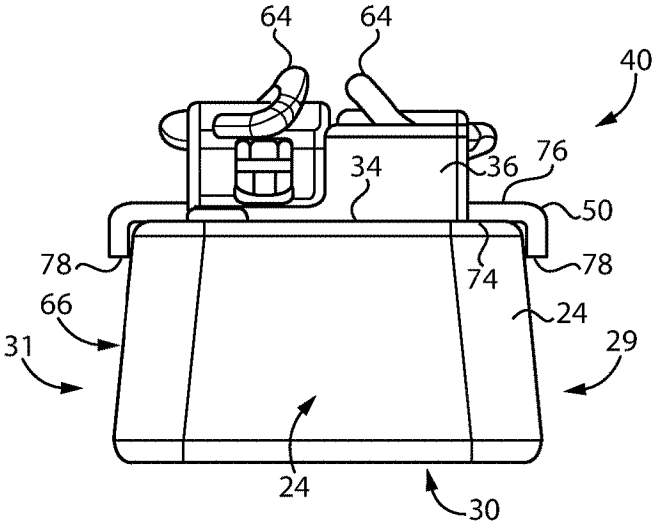
FIG. 3 is a diagrammatic end view of a direct fixation fastener assembly, according to one embodiment.

Referring also now to FIGS. 3 and 4 at least one of, first lateral side 26 and second lateral side 28, or forward side 29 and back side 31, together form an upwardly narrowed taper 66. When installed for service in poured concrete 14, upwardly narrowed taper 66 can assist in resisting vertical pullout of direct fixation fastener assembly 40. In an implementation, both of first lateral side 26 and second lateral side 28, and forward side 29 and back side 31, together respectively form upwardly narrowed tapers. Taper 66 can be understood as a fore-aft taper, and a taper formed by first lateral side 26 and second lateral side 28 could be understood as a lateral taper. It can further be seen from the drawings that support block 24 may have a trapezoidal fore-aft profile, and a trapezoidal lateral profile.

Also in a practical implementation, third-rail support bracket 50 includes a lower face 74 clamped against upper fastening surface 34, an upper face 76, and at least one stiffening wall 78 extending laterally between inboard bracket end 52 and outboard bracket end 54. In the illustrated embodiment, third-rail support bracket 50 includes a forward peripheral stiffening wall 78 and a back peripheral stiffening wall 78, with stiffening walls 78 extending downwardly from upper face 76. Each of upper face 76 and lower face 74 may be substantially planar. Third-rail support bracket 50 may be formed uniformly from a suitable non-metallic and electrically non-conductive material such as a composite material, made by molding, machining, extruding, or any other suitable process. As can also be seen from FIG. 5 in a partially sectioned portion of direct fixation fastener 36, direct fixation fastener 36 includes a metallic frame 42 having an upper rail plate 44, and a non-metallic overmolded jacket 46 encasing metallic frame 42 at least in part. The term "metallic frame" refers generally to any metal plate or plates, framing, or other metal structural parts used in a direct fixation fastener. The term "overmolded" means that jacket 46 extends at least part way over, around, or between one or more parts of metallic frame 46. While it is contemplated that a great variety of different direct fixation fasteners may be used in the context of the present disclosure, in a practical implementation an elastomeric or other non-metallic and non-conductive material will be used to form jacket 46 encasing metallic frame 46, providing electrical insulation and vibrational isolation. The present disclosure is not limited with regard to construction or type of direct fixation fastener used.

Figure 5:
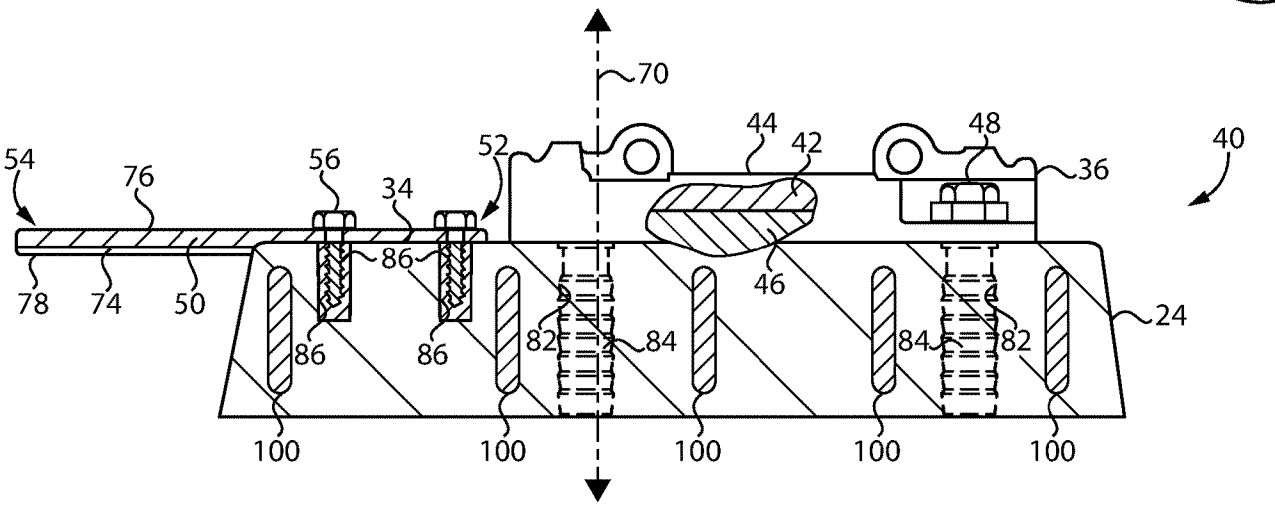
FIG. 5 is a sectioned diagrammatic view of a direct fixation fastener assembly, according to one embodiment.
Figure 6:
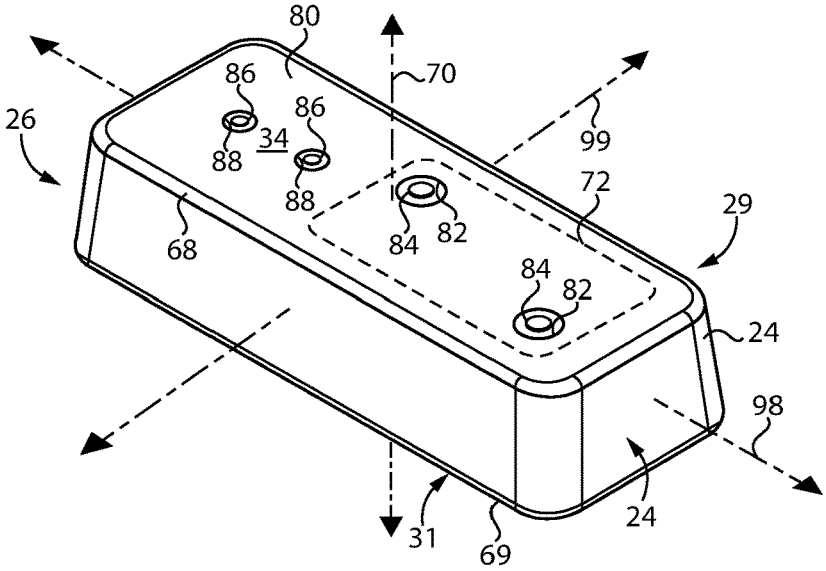
FIG. 6 is a perspective view of a support block for a direct fixation fastener assembly, according to one embodiment.
Figure 7:
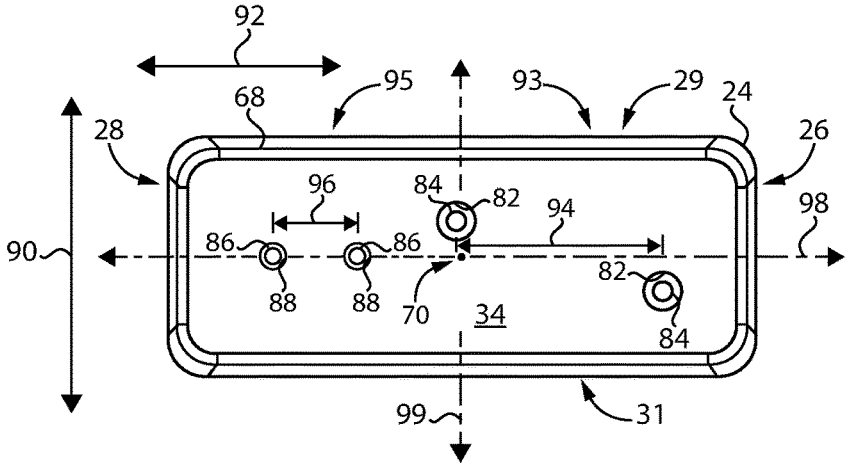
FIG. 7 is an elevational view of a support block for a direct fixation fastener assembly, according to one embodiment.

Referring now to FIGS. 5, 6, and 7, support block 24 further includes an upper perimetric edge 68 and a lower perimetric edge 69. Lower perimetric edge 69 defines a rectangular footprint having rounded corners, and upper perimetric edge 68 defines a second rectangular footprint having rounded corners. Upper fastening surface 34 extends peripherally around direct fixation fastener 36 and outwardly to upper perimetric edge 68. It will thus be understood that a spacing or clearance extends peripherally around direct fixation fastener 36 upon all sides, in the illustrated embodiment, and may be substantially uniform in size between direct fixation fastener 36 and each of forward side 29, back side 31, and first lateral side 26. The clearance or spacing around direct fixation fastener 36 may be larger between direct fixation fastener 36 and second lateral side 28 to accommodate third-rail support bracket 50 upon support block 24.

Support block 24 further defines a vertical center axis 70 extending between lower side 30 and upper side 32. Direct fixation fastener 36 defines a contact footprint 72 with upper fastening surface 34 that is laterally off-centered from vertical center axis 70. While contact footprint 72 can shift where direct fixation fastener 36 is laterally or fore-aft adjusted, contact footprint 72 will nevertheless typically remain off-centered from vertical center axis 70.

Support block 24 may be formed of a concrete matrix material produced such as by casting, with certain molded-in features structured and arranged to matingly accommodate fastener-clamping fasteners 48 and bracket-clamping fasteners 56. The subject matrix material is shown in FIG. 5 at reference numeral 80 and may extend throughout support block 24 but for the various molded-in features. In FIG. 5, molded-in rebar reinforcements 100 are shown in the subject section plane, and may form a rebar cage within support block 24 together with rebar pieces or portions not shown. Embodiments are contemplated where rebar also extends externally of matrix material 80 outside of support block 36 for handling of direct fixation fastener assembly 40 during manufacturing, transport, or installation. As suggested above, a first set of fastener holes 82 are formed in support block 24, and open in upper fastening surface 34. Molded-in fastener-clamping anchors 84 are resident in the first set of fastener holes 82, and held fast within matrix material 80 of support block 24, to receive fastener-clamping fasteners 48 for clamping direct fixation fastener 36 to upper fastening surface 34. A second set of fastener holes 86 are formed in support block 24 and open in upper fastening surface 34. Bracket-clamping anchors 88 are resident in the second set of fastener holes 86, and held fast within matrix material 80, to receive bracket-clamping fasteners 56 for clamping third-rail support bracket 50 to upper fastening surface 34. Bracket-clamping fasteners 56 and fastener-clamping fasteners 48 may be threaded bolts, threaded studs paired with nuts, or the like, or other suitable fasteners. The first set of fastener holes 82 are arranged in a first anchor pattern, and the second set of fastener holes 86 are arranged in a second anchor pattern different from the first anchor pattern.

In an implementation, the first anchor pattern and the second anchor pattern differ in at least one of a hole number, a hole-to-hole spacing in a fore-aft direction 90, a hole-to-hole spacing in a lateral direction 92, or a geometric arrangement. It will be understood that both the respective sets of fastener holes 82 and 86, the respective anchors 84 and 88, and the respective clamping fasteners 48 and 56 are all understood to be arranged in the associated first or second anchor patterns.

It is contemplated that a variety of different direct fixation fasteners can be suitably used in direct fixation fastener assembly 40. Analogously, a variety of different third-rail support brackets can be used in direct fixation fastener assembly 40 and fastening system 22. Direct fixation fasteners might be structured for attachment to support block 24 with a total of two clamping fasteners, a total of three clamping fasteners, or a total of four clamping fasteners, for instance. A third-rail support bracket herein might be structured for attachment to support block 24 with a total of two clamping fasteners, a total of three, or a total of four, for instance. Fastener-clamping fasteners, and associated holes and anchors, might be arranged in a rectangular pattern, a trapezoidal pattern, a linear pattern, a triangular pattern, or still another. Bracket-clamping fasteners, and associated holes and anchors, may likewise be arranged in a rectangular anchor pattern, a triangular anchor pattern, a trapezoidal anchor pattern, a linear pattern, or still another. In the illustrated embodiment the first anchor pattern is a linear pattern, and the second anchor pattern is also a linear pattern, with each having a hole number of 2. The first anchor pattern can be understood as oriented angularly to, or canted to, the second anchor pattern.

Support block 24 defines a major axis 98 extending in lateral direction 92, between first lateral side 26 and second lateral side 28. Support block 24 also defines a minor axis 99 extending in fore-aft direction 90 between forward side 29 and back side 31. The first anchor pattern may define a forwardmost anchor location that is between major axis 98 and forward side 29 in fore-aft direction 90. The first anchor pattern may also define a backmost anchor location that is between major axis 98 and back side 31 in fore-aft direction 90. The second anchor pattern may define at least one anchor location, and in the illustrated embodiment defines two, that overlaps major axis 98 in fore-aft direction 90. A hole-to-hole spacing 94 in lateral direction 92 defined by the first anchor pattern may be greater than a hole-to-hole spacing 96 in lateral direction 92 defined by the second anchor pattern. A hole size of the first set of fastener holes 82 may also be larger than a hole size of the second set of fastener holes 86, although the present disclosure is not thereby limited. It can still further be observed from the drawings that the first set of fastener holes 82 are confined in distribution to a right-side portion 93 of support block 24 extending from first lateral side 26 toward second lateral side 28. The second set of fastener holes 86 are confined in distribution to a left-side portion 95 of support block 24 extending from second lateral side 28 toward first lateral side 26. Right side portion 93 may be one lateral half of support block 24, and left side portion 95 may be one lateral half of support block 24, although in a practical implementation right-side portion 93 may be slightly larger than left-side portion 95 with the leftmost hole 82 being aligned with or just left of minor axis 99. The terms "left-side" and "right-side" are used herein for convenience of description and would vary in reference frame based upon perspective.

Figure 8:
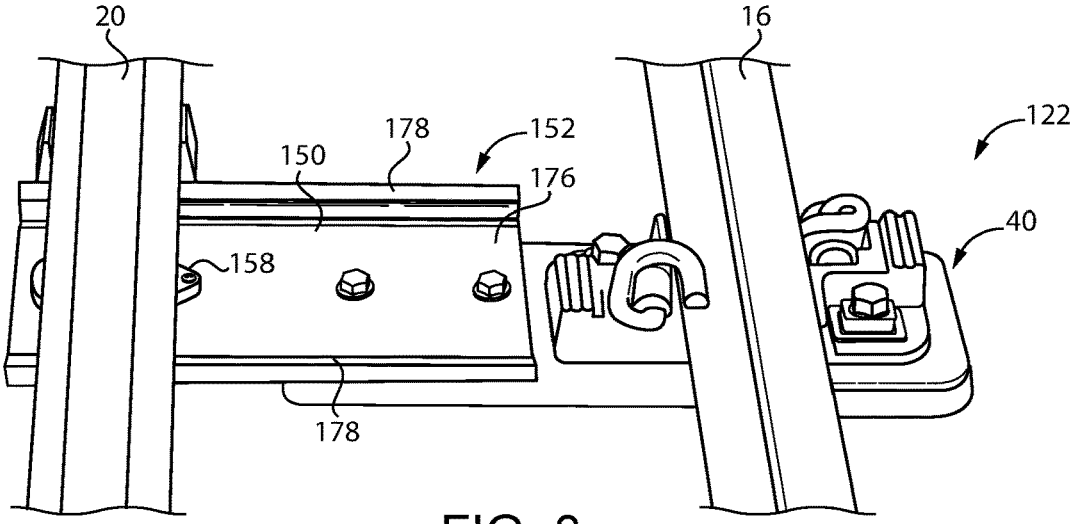
FIG. 8 is a perspective view of a track rail fastening system, according to another embodiment.

Referring now to FIG. 8, there is shown a track rail fastening system 122 according to another embodiment, and including a direct fixation fastener assembly 40 that may be substantially identical to the aforementioned direct fixation fastener assembly embodiments, and is thus commonly numbered. Fastening system 122 includes a third-rail support bracket 150 having an inboard bracket end 152 clamped to a support block of fastener assembly 40. Third-rail support bracket 150 includes a plurality of peripheral stiffening walls 178. In contrast to stiffening wall 78 in support bracket 50, peripheral stiffening walls 178 extend upwardly from an upper surface 176 of support bracket 150. Other variations could include one stiffening wall that extends downward, and one stiffening wall that extends upward, stiffening walls that extend both upward from an upper support bracket upper face and downward from a support bracket upper face, a stiffening web, or still another stiffener structure. The present disclosure is contemplated to be applicable regardless of the specific construction of a third-rail support bracket that is used.

INDUSTRIAL APPLICABILITY

Referring to the drawings generally, it will be recalled that installation of certain track systems can be a labor-intensive process, in traditional approaches requiring track rails to be elevated above a deck and held in place as concrete is poured, often with the extensive use of concrete forms. According to the present disclosure, direct fixation fastener assemblies can be placed upon a prepared substrate, such as a rough pour of concrete inside a tunnel, and additional concrete poured around the direct fixation fastener assemblies. In certain instances, a section of track rail might be prepared without any need for separate support or suspension of track rails. It is also contemplated that according to the present disclosure preparation of concrete forms, post-pouring returns to a site by a concrete crew, and other labor intensive activities such as post-pour mitigation work to eliminate voids in or around support blocks, may be reduced or eliminated. Third-rail installation adds to the labor burden of track system installation. According to another aspect of the present disclosure, third-rail support brackets and pedestal mounts can be installed upon direct fixation fastener assemblies prior to pouring concrete, or potentially even prior to placement upon a prepared deck. Embodiments are thus contemplated where an entirety or substantially an entirety of a length of track rail but for poured concrete can be prepared in advance, with pouring the concrete being generally the final step in construction.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed:

1. A track rail fastening system comprising:

a laterally elongated support block including a first lateral side, a second lateral side, a ground-facing lower side, and an upper side opposite to the lower side and having an upper fastening surface that is continuously planar from the first lateral side to the second lateral side;

a direct fixation fastener positioned upon the upper fastening surface adjacent to the first lateral side, and including a metallic frame having an upper rail plate, and a non-metallic jacket;

fastener-clamping fasteners coupling the direct fixation fastener to the support block upon the upper fastening surface;

a one-piece third-rail support bracket having an inboard bracket end adjacent to the direct fixation fastener, and an outboard bracket end, and the one-piece third-rail support bracket being formed of a non-metallic material;

bracket-clamping fasteners coupling the inboard bracket end to the support block upon the upper fastening surface;

the third-rail support bracket projects laterally outward of the second lateral side, such that the outboard bracket end is cantilevered to the support block;

the inboard bracket end including an inboard terminal end, and the outboard bracket end including an outboard terminal end, and the third-rail support bracket further including at least one full-length stiffening wall extending laterally from the inboard terminal end to the outboard terminal end;

the third-rail support bracket further including an upper face, and a lower face clamped in contact with the laterally elongated support block, and the at least one full-length stiffening wall is spaced from the upper fastening surface in a fore-aft direction; and the upper face being continuously planar from the inboard bracket end to the outboard bracket end.

2. The fastening system of claim 1 wherein the support block further includes a forward side and a back side, and at least one of, the first lateral side and the second lateral side, or the forward side and the back side, together form an upwardly narrowed taper.

3. The fastening system of claim 2 wherein the support block further includes an upper perimetric edge, and the upper fastening surface extends peripherally around the direct fixation fastener and outwardly to the upper perimetric edge.

4. The fastening system of claim 3 wherein the support block defines a vertical center axis extending between the lower side and the upper side, and the direct fixation fastener defines a contact footprint with the upper fastening surface that is laterally off-centered from the vertical center axis.

5. The fastening system of claim 2 wherein the support block includes a matrix material, and further comprising molded-in bracket anchors held fast within the matrix material and engaged with the bracket-clamping fasteners.

6. The fastening system of claim 5 wherein the molded-in bracket anchors are arranged in a first anchor pattern, and further comprising molded-in fastener anchors held fast within the matrix material, engaged with the fastener-clamping fasteners and arranged in a second anchor pattern different from the first anchor pattern.

7. The fastening system of claim 5 wherein the support block further includes molded-in reinforcements within the matrix material.

8. The fastening system of claim 7 further comprising an upwardly projecting pedestal mount attached to the outboard end of the third-rail support bracket.

9. The fastening system of claim 1 wherein the third-rail support bracket includes a lower face clamped against the upper fastening surface, an upper face, and the at least one stiffening wall is one of a plurality of stiffening walls extending laterally between the inboard terminal end and the outboard terminal end.

10. The fastening system of claim 9 wherein the plurality of stiffening walls project upwardly in a direction away from the upper face.

11. A track rail fastening system comprising:

a laterally elongated support block including a first lateral side, a second lateral side, a ground-facing lower side, and an upper side opposite to the lower side and having an upper fastening surface that is continuously planar from the first lateral side to the second lateral side;

a direct fixation fastener positioned upon the upper fastening surface adjacent to the first lateral side, and including a metallic frame having an upper rail plate, and a non-metallic jacket;

fastener-clamping fasteners coupling the direct fixation fastener to the support block upon the upper fastening surface;

a one-piece third-rail support bracket having an inboard bracket end adjacent to the direct fixation fastener, and an outboard bracket end;

bracket-clamping fasteners coupling the inboard bracket end to the support block upon the upper fastening surface;

the third-rail support bracket projects laterally outward of the second lateral side, such that the outboard bracket end is cantilevered to the support block;

the third-rail support bracket further including a forward stiffening wall and a back stiffening wall each extending laterally between the inboard end and the outboard end, an upper face, and a lower face clamped in contact with the laterally elongated support block, and the upper face being continuously planar from the inboard bracket end to the outboard bracket end; and each of the forward and the back stiffening walls extends vertically downward from the lower face to a location that is vertically below the upper fastening surface, and the laterally elongated support block is positioned between the forward and the back stiffening walls in a fore-aft direction.

12. The fastening system of claim 11 wherein the one-piece third rail support bracket is formed uniformly from a non-metallic material.

13. The fastening system of claim 11 wherein the direct fixation fastener is shorter in the fore-aft direction than the one-piece third rail support bracket in the fore-aft direction.

* * * * *